United States Patent [19]

Henson

[11] Patent Number: 4,946,004

[45] Date of Patent: Aug. 7, 1990

[54] POLE GRIPPING LADDER STABILIZING DEVICE

[76] Inventor: Kenneth H. Henson, 180 Ridge Rd., Candler, N.C. 28715

[21] Appl. No.: 423,175

[22] Filed: Oct. 16, 1989

[51] Int. Cl.[5] ..... E06C 7/48

[52] U.S. Cl. ..... 182/206; 182/107

[58] Field of Search ..... 182/206, 107, 93; 248/230, 231.5

[56] References Cited

U.S. PATENT DOCUMENTS

| | | | |
|---|---|---|---|
| 1,961,289 | 6/1934 | Gardner . | |
| 1,994,369 | 3/1935 | Risser . | |
| 2,232,414 | 2/1941 | Swann . | |
| 3,037,579 | 6/1962 | Barrow | 182/107 |
| 3,336,999 | 8/1967 | McSwain . | |
| 3,896,900 | 7/1975 | Hunter . | |
| 4,018,301 | 4/1977 | Namelhe . | |
| 4,090,587 | 5/1978 | Pyle . | |
| 4,363,378 | 12/1982 | Williams | 182/206 |
| 4,469,195 | 9/1984 | Sartain . | |

FOREIGN PATENT DOCUMENTS

| | | | |
|---|---|---|---|
| 228404 | 11/1910 | Fed. Rep. of Germany | 182/93 |
| 625682 | 2/1936 | Fed. Rep. of Germany | 182/206 |
| 903147 | 2/1954 | Fed. Rep. of Germany | 182/93 |
| 457935 | 6/1950 | Italy | 182/206 |

*Primary Examiner*—Reinaldo P. Machado

*Attorney, Agent, or Firm*—Bell, Seltzer, Park & Gibson

[57] ABSTRACT

This invention relates to a pole gripping assembly for use in stabilizing ladders used to ascend a tree, utility pole or the like. The assembly comprises a yoke member having an arcuate shape which is connected between the side rails at an upper end of a ladder. The yoke member is connected by brackets to the side rails for pivotal movement about a transverse axis so as to pivot at least between a plane common with the lader and a plane perpendicular to the ladder. The assembly further includes a pair of arcuate gripping arms which are pivotally connected to the yoke member adjacent opposite ends thereof. The gripping arms are biased to an open position to receive a pole and pivot to a closed position when a pole moves into a pole receiving space generally between the opposite ends of the yoke member. In accordance with the invention the gripping arms hold the pole in the pole receiving space until the ladder is withdrawn from the pole.

15 Claims, 3 Drawing Sheets

POLE GRIPPING LADDER STABILIZING DEVICE

FIELD OF THE INVENTION

This invention relates to ladder stabilizing devices and more particularly to ladder stabilizing devices for stabilizing the upper portions of long ladders which are used to climb trees, utility poles or the like.

BACKGROUND OF THE INVENTION

Ladders are used for a wide variety of tasks that require ascending to a level normally out of reach when standing on the ground or floor. Most ladders used for ascending substantial heights, such as heights in excess of four to six feet, are designed to stand on the ground and lean against a flat surface, such as a roof or wall of a house. However, when such ladders are used to ascend trees, utility poles and other non-flat surfaces, the ladder may tend to engage the non-flat surface along only one of the side rails of the ladder or along the top step thereof. As such, the ladder may tend to slide or twist as the climber ascends up the ladder or when the climber should lean outwardly to reach for something.

In view of the potential harm of a fall, several ladder stabilizing devices have been developed to provide a measure of safety for climbers. For example, U.S. Pat. No. 1,994,369 issued Mar. 12, 1935 to Risser shows a pole gripper disposed near the upper end of a ladder. The pole gripper has the shape of a "V" and rotates about a generally horizontal axis. However, the gripper only straddles the tree or pole without fully holding the same to prevent the ladder from sliding along the gripper.

A number of other stabilizing devices have means for gripping a tree or pole. Examples of such devices include U.S. Pat. No. 1,961,289 issued June 5, 1934 to Gardner, U.S. Pat. No. 2,232,414 issued Feb. 18, 1941 to Swann, U.S. Pat. No. 3,896,900 issued July 29, 1975 to Hunter, U.S. Pat. No. 4,018,301 issued Apr. 9, 1977 to Nameche, U.S. Pat. No. 4,090,587 issued May 23, 1978 to Pyle and U.S. Pat. No. 4,469,195 issued Sept. 4, 1984 to Surtain. However, there are several common features among the patented devices that hamper their utility and effectiveness. For example, several of the stabilizing devices require lifting the ladder off the ground and manipulating it to cause the grippers to grasp the pole. Since some ladders are quite heavy, this type of stabilizing device is generally impractical. Further, the gripping arrangements tend to be rather bulky and cumbersome making normal usage of the ladder at least inconvenient if not rather difficult.

Accordingly it is an object of the present invention to provide a ladder stabilizing device for use with poles, trees and the like which avoids the disadvantages of the prior art constructions as noted above.

It is a more particular object of the present invention to provide a ladder stabilizing device for use with poles, trees and the like which effectively grips the pole during use but also permits conventional use of the ladder without having to remove the ladder stabilizing device from the ladder.

SUMMARY OF THE INVENTION

The above and other objects of the invention have been achieved by the provision of an assembly comprising a yoke member adapted to be mounted transversely between the side rails at one end of a ladder for supporting the ladder against a pole. The yoke member has a pair of opposite ends and is of generally arcuate configuration. The portion intermediate the opposite ends defines a pole receiving space generally between the opposite ends. A pair of gripping arms are pivotally mounted to the yoke member adjacent respective ones of the opposite ends of the yoke member for pivotal movement between an open position for receiving a pole into the pole receiving space and a closed position for holding a pole in the pole receiving space to the yoke member. The gripping arms include inner arm portions positioned in the pole receiving space when the gripping arms are in the open position for engaging a pole as it enters the pole receiving space and causing said gripping arms to pivot from the open position to the closed position. The assembly further comprises an arrangement for biasing the gripping arms to the open position.

The assembly is preferably provided with brackets adapted to be secured to the side rails of the ladder for pivotally connecting each of the opposite ends of the yoke member to the ladder. The yoke member is therefore permitted to move pivotally about a transverse axis so that the pole gripping assembly may be selectively pivoted to an inoperative or stowed orientation wherein the assembly lies in a common plane with the side rails of the ladder, or to an operative orientation wherein the assembly is disposed generally perpendicular to the side rails of the ladder.

BRIEF DESCRIPTION OF THE DRAWINGS

Some of the features and advantages of the invention have been stated and others will become apparent as the description proceeds when taken in conjunction with the drawings in which.

DETAILED DESCRIPTION OF THE PREFERRED EMBODIMENT

Figure 1:
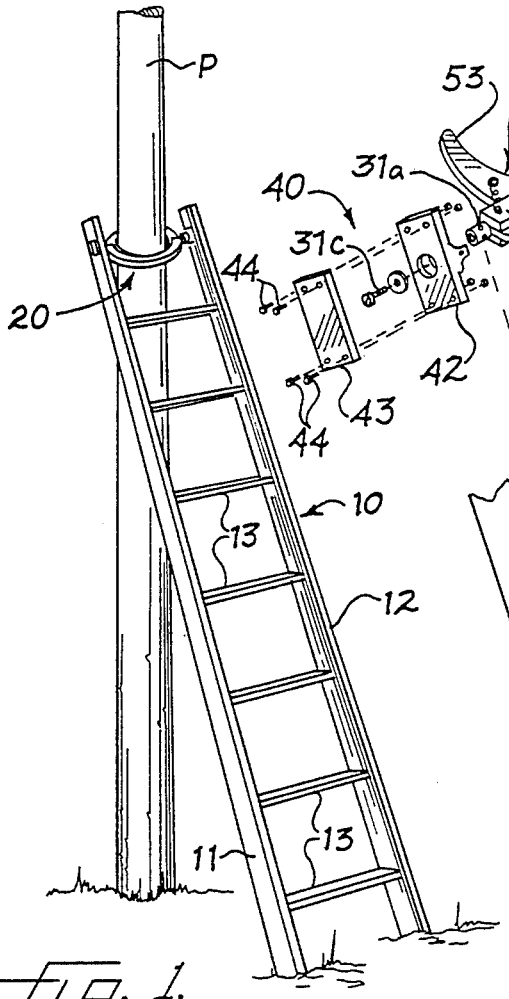
FIG. 1 is a front perspective view of a ladder with a pole gripping assembly embodying the features of the present invention leaning against and gripping a pole.

Referring now more particularly to the drawings, FIG. 1 illustrates a ladder of conventional design generally indicated by the numeral 10. The ladder 10 includes a pair of generally parallel elongate spaced apart side rails 11 and 12 and a series of steps 13 transversely connecting the side rails 11 and 12. The steps 13 are spaced apart by a standard distance along the length of the side rails 11 and 12 to provide integral strength for the ladder 10 and suitable steps for climbing. As illustrated, the ladder is adapted to stand upright on the ground and lean against an object to which elevated access is desired.

At the upper end of the ladder 10, mounted between the side rails 11 and 12 is a pole gripping assembly incorporating the features of the present invention and generally indicated by the numeral 20 for gripping the pole P. The pole gripping assembly 20 is particularly adapted to be leaned against a pole or tree and grasp the same until the assembly 20 is withdrawn away. Thus, the upper portion of the ladder 10 is held to the pole particularly while a climber is on the ladder.

Figures 5, 6:
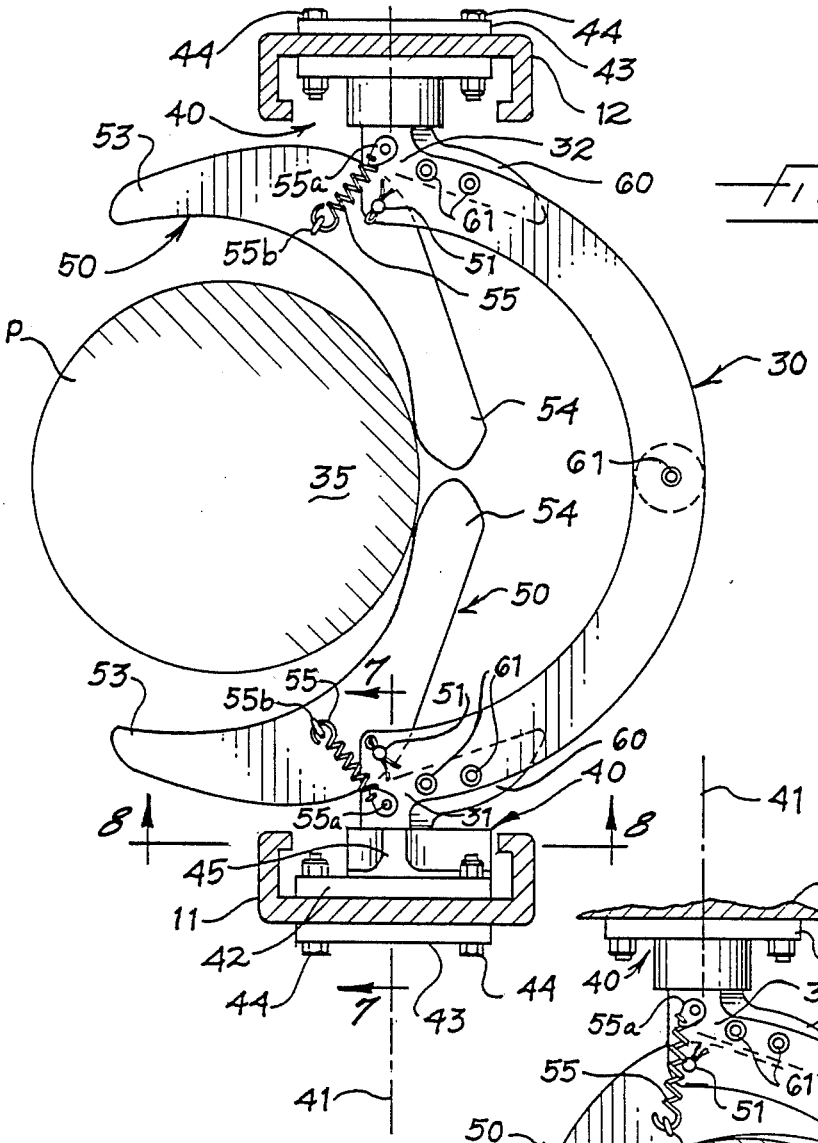
FIG. 5 is a top view of the pole gripping assembly in its open position.
FIG. 6 is a top view similar to FIG. 5 with the pole gripping assembly in its closed position gripping the pole.

Referring now to FIG. 5, the pole gripping assembly 20 comprises a yoke member 30 having opposite ends 31 and 32. The yoke member 30 further has a generally arcuate configuration approximating the shape of a "U". While other arcuate shapes may be suitable, in the preferred embodiment the yoke member 30 has the shape of approximately half of a circular ring. A pole receiving space 35 is defined between the ends 31 and 32 and within the inner periphery of the portion intermediate the ends 31 and 32. The pole receiving space 35 may be generally described as a circular shaped area where a pole would likely rest when the pole gripping assembly 20 is gripping and holding a pole such as a tree, utility pole or the like.

Figure 4:
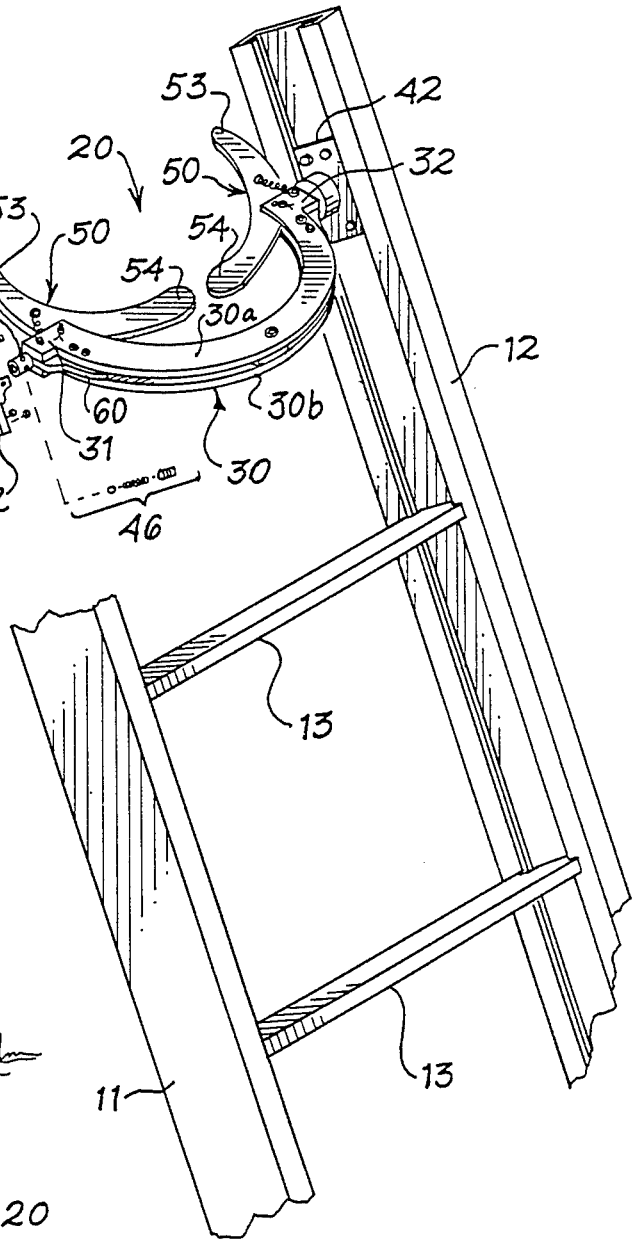
FIG. 4 is an enlarged fragmentary and exploded perspective view of the ladder and pole gripping assembly.
Figure 7:
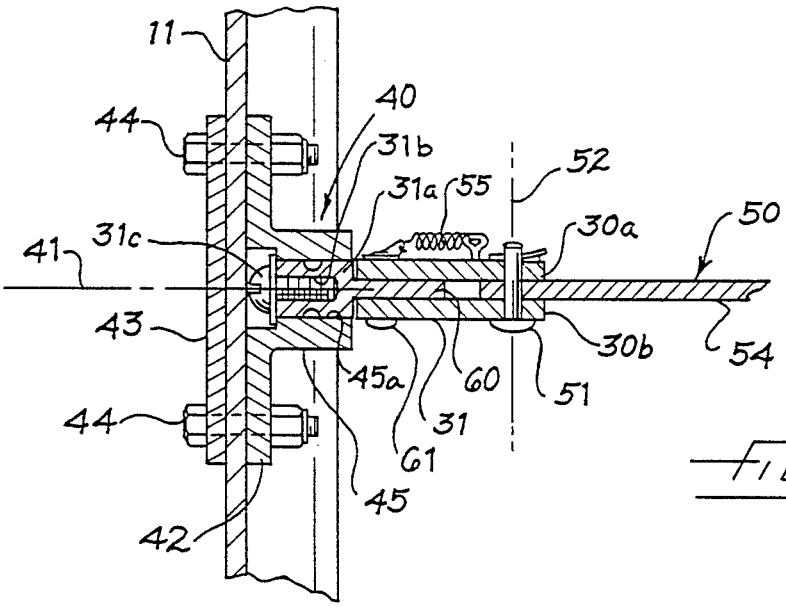
FIG. 7 is an enlarged fragmentary cross section view of the pole gripping assembly taken along line 7—7 in FIG. 5.

The yoke member 30 is mounted between the side rails 11 and 12 by a pair of brackets generally indicated by the numeral 40. The brackets permit the yoke member 30 to rotate about a transverse axis 41 generally extending through the opposite ends 31 and 32. In the preferred embodiment and as best seen in FIGS. 4 and 7, the brackets 40 comprise inner and outer blocks 42 and 43 positioned on opposite sides of each respective side rail 11 and 12. Focusing particularly on the bracket 40 attached to side rail 11, the blocks 42 and 43 are secured to one another by bolts 44 or other conventional means so as to sandwich the side rail 11 and be securely attached thereto. The inner block 42 includes an inwardly extending journal 45 which has a bore **45*a* therein, which is coaxial with the transverse axis 41. The bore 45*a* includes a first diameter portion at the inner or free end thereof and a larger second diameter portion adjacent to the side rail 11**. A shoulder is thus formed between the first and second diameter portion for purposes to be discussed below.

The bore **45*a* receives a rod 31*a* extending outwardly from the end 31 of the yoke member 30 coaxial to the transverse axis 41. The rod 31*a* is sized to extend approximately the length of the smaller diameter portion of the bore 45*a* and it is adapted to rotate in the bore 45*a* about the transverse axis 41. The rod 31*a* also includes a threaded bore 31*b* at the distal end thereof for receiving a screw 31*c*. The screw 31*c* has an enlarged head to overlie the shoulder formed in the bore 45*a* so as to secure the rod 31*a* down in the bore 45*a* of the inner block 42. Accordingly to assemble of the pole gripper assembly 20, the inner block 42 should be attached to the yoke member 30 with the screw 31*c* prior to the attachment of blocks 42 and 43 to the side rail 11 so as to allow access to the screw 31*c***.

Figure 2:
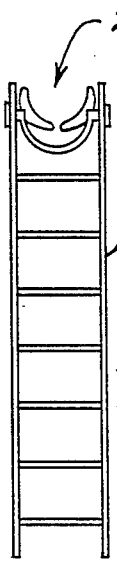
FIG. 2 is a front elevation view of the ladder with the pole gripping assembly in its stowed orientation in which the assembly lies in a generally common plane with the ladder.
Figure 3:
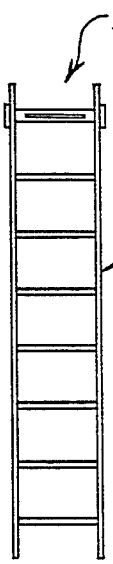
FIG. 3 is a front elevation view similar to FIG. 2, with the pole gripping assembly in its operative orientation in which the assembly is in a generally horizontal plane generally perpendicular to the plane of the ladder.

While the brackets 40 permit complete rotation of the yoke member 30 about the transverse axis 41, the assembly 20 will typically be subjected to pivotal movement between a stowed position, illustrated in FIG. 2, and an operative position illustrated in FIG. 3. In the stowed position, the entire assembly 20 lies between the side rails 11 and 12 in a generally common plane with the ladder 10. In this position, the assembly 20 is out of the way for conventional use and storage of the ladder. Conversely, in the operative position, the assembly 20 lies generally perpendicular to the plane of the ladder 10.

Figure 8:
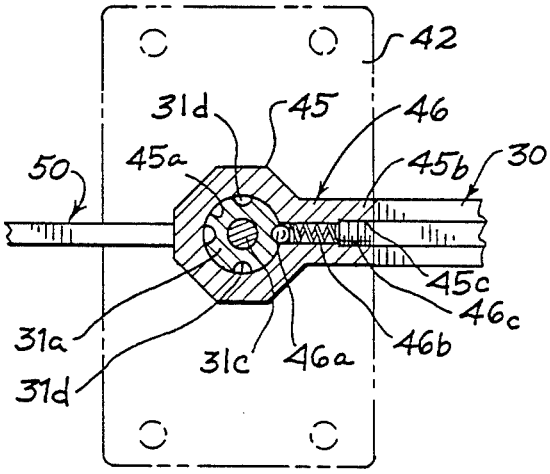
FIG. 8 is a cross section view of the pole gripping assembly taken along line 8—8 in FIG. 5.
Figure 9:
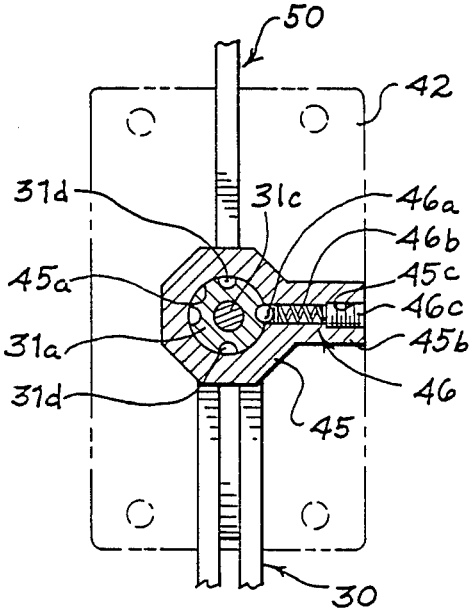
FIG. 9 is a cross section view similar to FIG. 8 with the pole gripping assembly in its stowed orientation.

As part of the preferred embodiment of the present invention, a detent is provided at one of the brackets 40. As illustrated in FIGS. 5, 8 and 9, the bracket 40 attached to side rail 11 includes the detent, generally indicated by the numeral 46, for maintaining the yoke member 30 in any one of several predetermined orientations about the transverse axis 41 with respect to the ladder 10. For example, the detent 46 preferably provides stops in the stowed position and in operative position. As best seen in FIGS. 8 and 9, the detent 46 comprises a number of concave portions **31*d* in the rod 31*a* at predetermined positions along the circumferential surface thereof. The block 42 also includes a laterally extending portion 45*b* which extends laterally from the journal 45. Within the laterally extending portion 45*b* is a threaded bore 45*c* intersecting with and extending perpendicularly to the bore 45*a*. A ball 46*a* is positioned in the threaded bore 45*c* to contact the circumferential surfact of the rod 31*a* and is biased toward the circumferential surface by a spring 46*b*. The spring 46*b* is held in place by a headless set screw 46*c*. As the assembly 20 rotates about the axis 41, the ball 48*a* encounters the concave portions 31*d* and, by the force of the spring 46*b*, moves partially into each concave portion 31*d*. The ball 46*a*, once positioned in one of the concave portions 31*d*, provides a resistance to the rotation of the yoke member 30 about the transverse axis 41. The resistance caused by the detent 46 is such, that one might easily overcome the resistance when it is intended to rotate the yoke member 30 but it is also sufficient to effectively resist most routine vibrations and jarring of the ladder. By adjusting the headless set screw 46*c* inwardly or outwardly of the threaded bore 45*c*, the resistance of the detent 46** may be adjusted as desired.

In conjunction with the yoke member 30, a pair of gripping arms 50 are positioned near the opposite ends 31 and 32 of the yoke member 30 to hold a pole in the pole receiving space 35. The gripping arms 50 are generally arcuately shaped members, i.e. they are shaped somewhat like an "L", and they are each connected to the yoke member 30 by a respective pivot pin 51. The pivot pins 51 are located adjacent each of the opposite ends 31 and 32 and pivotally connect the gripping arms 50 at about a medial portion thereof. As such, each gripping arm 50 defines an outer arm portion 53 and an inner arm portion 54 extending from generally opposite sides of the associated pivot pin 52. Extending coaxially through each pivot pin 51 is a pivot axis 52 (FIG. 7) about which the gripping arms 50 pivot. The pivot axes 52 are disposed generally perpendicularly to the transverse axis 41.

As best illustrated in FIGS. 5 and 6, the gripping arms 50 pivot between an open position (FIG. 5) which is adapted to receive a pole and a closed position (FIG. 6) for holding a pole in the pole receiving space 35 to the yoke member 30. More particularly, in the open position, the outer arm portions 53 extend outwardly from the yoke member 30 so as to be adapted to receive the pole therebetween, and the inner arm portions 54 extend into said pole receiving space 35. In the closed position, the outer arm portions 53 extend generally toward each other across the pole receiving space 35 and spaced from the yoke member 30 while the inner arm portions 54 overlie the yoke member 30 to essentially pivot out of the way of the pole P in the pole receiving space 35. The gripping arms 50 are biased toward the open position as will be explained, thus the inner arm portions 54 are adapted to engage a pole as it enters the pole receiving space and cause the gripping arms 50 to pivot from the open position to the closed position so as to retain the pole in the pole receiving space 35. The biasing force for each gripping arm 50 is provided by a spring 55 which is connected at one end to a connector 55*a* on the respective end of the yoke member 30, and at its opposite end to a pin 55*b* on the outer arm portion 53 of the gripping arm 50. The spring 55 is arranged to provide a tension force between the connector 55*a* and the pin 55*b* along a line which lies outside the pivot pin 51 i.e. on the side of the pin opposite the yoke member 30.

One particular feature of the preferred embodiment is best seen in FIGS. 4 and 7. The yoke member 30 is more particularly comprised of a pair of generally flat plates 30*a* and 30*b* which overlie one another and are spaced apart by a number of spacers 60 which are positioned between the plates 30*a* and 30*b*. Also, as best seen in FIG. 7, the spacers 60 are integral with the rods 31*a* and a number of rivets 61 extend through the plates and the spacers to maintain their interconnection. The gripping arms 50 are generally flat and sized to fit into the space between the plates 30*a* and 30*b* and are mounted therein with the pivot pins 51 extending completely therethrough. When the gripping arms 50 pivot to the closed position, the inner arm portions 54 slip into the space between the plates 30*a* and 30*b* in relatively close contacting relationship. As such, the yoke member 30 provides substantial support for the gripping arms 50 when the gripping arms are in the closed position. As should be apparent, the outer arm positions 53 are gripping and holding a pole when in the closed position and strength and rigidity of the arms 50 necessary at such time. Thus by the preferred design, the pole gripping assembly 20 may be relatively simple and lightweight at the same time providing the necessary strength and rigidity for holding the ladder 10 to the pole P.

Turning now to the use and operation of the invention, the pole gripping assembly 20 is adapted to be mounted at the upper end of a conventional ladder 10. The assembly may be substituted for the top step of the ladder 10 if there is not sufficient room between the side rails 11 and 12 above the top step 13. When the assembly 20 is in place between the side rails 11 and 12, it is typically pivoted about its transverse axis 41 so as to lie in a generally common plane with the ladder 10, which is its stowed orientation as seen in FIG. 2. The detent 46 in the bracket 40 is provided to hold the assembly 20 in this orientation until someone pivots the same to a different orientation. Thus, the latter 10 can be carried, stored, and used like any conventional ladder, by virtue of the assembly 20 being completely within the plane of the ladder 10 and held in the stowed orientation.

When it is desired to lean the ladder against a pole, such as for utility maintenance, the assembly 20 is pivoted at a generally right angle from its stowed position to its operative position (FIG. 3). The ladder 10 is then raised and leaned onto the pole. As the assembly 20 moves into engagement with the pole (FIG. 5) the gripping arms pivot from the open position towards the closed position (FIG. 6) by the contact between the pole and the inner arm portions 54 of the arms. At this time, without any operational manipulation of the assembly, the assembly 20 grips the pole as illustrated in FIGS. 1 and 6. An additional feature to note is that the pole is received in a pole receiving position which is between the side rails 11 and 12. This is in contrast with prior art devices which space the ladder from the pole. Spacing the ladder from the pole is an inherently less stable arrangement than having the latter straddle the pole. Moreover, by the present invention, the weight of the climber on the ladder further causes the gripping arms to lock the pole P to the yoke member 30. Finally, when the task requiring the ladder is completed and the climber is off the ladder, the ladder 10 may be drawn away from the pole P. The assembly 20 will easily release the pole P again without any manipulation thereof and the springs 55 return the arms to their open position.

In the drawings and specification, there has been set forth a preferred embodiment of the invention, and although specific terms are employed, they are used in a generic and descriptive sense only and not for purposes of limitation.

That which I claim is:

1. A ladder comprising a pair of generally parallel elongate spaced apart side rails and a series of steps transversely connecting said side rails at predetermined positions along the length thereof in combination with a pole gripping assembly for stabilizing the upper portion of the ladder when the upper portion is positioned to rest against a utility pole or the like, said pole gripping assembly comprising:

a yoke member mounted transversely between said side rails adjacent one end of said ladder for supporting said ladder against a pole or the like, said yoke member having a pair of opposite ends and being of generally arcuate configuration such that the portion intermediate said opposite ends defines a pole receiving space generally between said opposite ends;

a pair of gripping arms pivotally mounted to said yoke member adjacent respective ones of said opposite ends for pivotal movement between an open position for receiving a pole into the pole receiving space and a closed position for holding a pole in the pole receiving space to said yoke member, said gripping arms including inner arm portions positioned in said pole receiving space when said arms are in said open position for engaging a pole as it enters the pole receiving space and for causing said gripping arms to pivot from said open position to said closed position; and means for biasing said gripping arms toward said open position whereby the ladder may be inclined uprightly against a pole and the pole gripping assembly may grip and hold the pole and release the pole when the ladder is pulled away therefrom.

2. The combination according to claim 1, wherein said pair of gripping arms are pivotally connected to said yoke member at respective pivot points located adjacent each of said opposite ends of said yoke member, with said gripping arms each including an outer arm portion on one side of its associated pivot point and with said inner arm portion being positioned on the other side of its associated pivot point, and wherein said outer arm portions extend generally outwardly from said yoke member in said open position and extend generally toward each other across said pole receiving space and spaced from said yoke member in said closed position.

3. The combination according to claim 2, wherein said yoke member comprises a pair of generally flat plates overlying and spaced apart from one another, and wherein said inner arm portions are positioned and sized to fit between said plates when said gripping arms are in said closed position.

4. The combination according to claim 1 further comprising bracket means secured to said side rails for pivotally connecting each of said opposite ends of said yoke member to said ladder and for permitting pivotal movement of said yoke member about a transverse axis and wherein said pole gripping assembly may be selectively pivoted into a stowed orientation wherein the assembly lies in a common plane with said ladder or to an operative orientation wherein the assembly is generally perpendicular to the plane of said ladder.

5. The combination according to claim 4, wherein said pair of gripping arms are pivotally connected to said yoke member at respective pivot points adjacent each of said opposite ends of said yoke member, and wherein said pivot points each define a pivot axis, and further wherein each of said pivot axes is generally perpendicular to said transverse axis.

6. The combination according to claim 4, wherein said bracket means includes detent means for releasably maintaining said yoke member in each of said stowed orientation and said operative orientation.

7. The combination according to claim 1, wherein said yoke member is generally U-shaped to define a relatively large pole receiving space.

8. A ladder comprising a pair of generally parallel elongate spaced apart side rails and a series of steps transversely connecting said side rails at predetermined positions along the length thereof in combination with a pole gripping assembly for stabilizing the upper portion of the ladder when the to upper portion is positioned to rest against a utility pole or the like, said pole gripping assembly comprising:

a yoke member mounted transversely between said side rails adjacent one end of said ladder for supporting said ladder against a pole or the like, said yoke member having a pair of opposite ends and being of generally arcuate configuration such that the portion intermediate said opposite ends defines a pole receiving space generally between said opposite ends and wherein said yoke member comprises a pair of generally flat plates overlying and spaced apart from one another;

bracket means secured to said side rails for pivotally connecting said yoke member to said ladder and for permitting pivotal movement of said yoke member about a transverse axis wherein said pole gripping assembly may be selectively rotated into a generally common plane with said ladder or into a plane generally perpendicular to the plane of said ladder;

a pair of gripping arms pivotally mounted to said yoke member at respective pivot points located adjacent each of said opposite ends of said yoke member for pivotal movement between an open position for receiving a pole into the pole receiving space and a closed position for holding a pole in the pole receiving space to said yoke member, said gripping arms each including an outer arm portion on one side of its associated pivot point and a inner arm portion positioned on the other side of its associated pivot point wherein said outer arm portions extend generally outwardly from said yoke member in said open position and extend generally toward each other across said pole receiving space and spaced from said yoke member in the closed position, and further wherein said inner arm portions extend into said pole receiving space when said gripping arms are in said open position for engaging a pole as it enters the pole receiving space and causing said gripping arms to pivot from said open position to said closed position, and with said inner arm portions being positioned and sized to fit between said plates of said yoke member when said gripping arms are in said closed position; and means for biasing said gripping arms toward said open position whereby the ladder may be inclined uprightly against a pole and the pole gripping assembly may grip and hold the pole and release the pole when the ladder is pulled away therefrom.

9. A pole gripping assembly adapted for attachment between the side rails of a ladder to stabilize the upper portion of the ladder when it is positioned to rest against a utility pole or the like, said assembly comprising:

a yoke member adapted to be mounted transversely between the side rails at one end of a ladder for supporting the ladder against a pole, said yoke member having a pair of opposite ends and being of generally arcuate configuration such that the portion intermediate said opposite ends defines a pole receiving space generally between said opposite ends;

a pair of gripping arms pivotally mounted to said yoke member adjacent respective ones of said opposite ends for pivotal movement between an open position for receiving a pole into the pole receiving space and a closed position for holding a pole in the pole receiving space to said yoke member, said gripping arms including inner arm portions positioned in said pole receiving space when said gripping arms are in said open position for engaging a pole as it enters the pole receiving space and causing said gripping arms to pivot from the open position to the closed position; and means for biasing said gripping arms toward said open position whereby a pole may be gripped and released by moving the assembly into and out of engagement with the pole.

10. The assembly according to claim 9, wherein said pair of gripping arms are pivotally connected to said yoke member at respective pivot points located adjacent each of said opposite ends of said yoke member, with said gripping arms each including an outer arm portion on one side of its associated pivot point, and wherein said outer arm portions extend generally outwardly from said yoke member in said open position and extend generally toward each other across said pole receiving space and spaced from said yoke member in said closed position.

11. The assembly according to claim 10, wherein said yoke member comprises a pair of generally flat plates overlying and spaced apart from one another, and wherein said inner arm portions are positioned and sized to fit between said plates when said gripping arms are in said closed position.

12. The assembly according to claim 9, further comprising bracket means adapted to be secured to said side rails for pivotally connecting each of said opposite ends of said yoke member to said ladder and for permitting pivotal movement of said yoke member about a transverse axis whereby the pole gripping assembly may be selectively pivoted to lie in a common plane with the side rails of the ladder or in a plane substantially perpendicular to the plane of the ladder.

13. The assembly according to claim 12, wherein said gripping arms are pivotally connected to said yoke member at respective pivot points adjacent each of said opposite ends of said yoke member, and wherein said pivot points each define a pivot axis, and further wherein each of said pivot axes is generally perpendicular to said transverse axis.

14. The assembly according to claim 9, wherein said bracket means includes detent means for maintaining said yoke member in a predetermined orientation about said transverse axis.

15. The assembly according to claim 9, wherein said yoke member is generally U-shaped to define a relatively large pole receiving space.

* * * * *